US005839269A

United States Patent [19]

Frutschi

[11] Patent Number: 5,839,269

[45] Date of Patent: Nov. 24, 1998

[54] METHOD OF OPERATING A COMBINED GAS AND POWER STEAM PLANT

[75] Inventor: Hans Ulrich Frutschi, Riniken, Switzerland

[73] Assignee: Asea Brown Boveri AG, Baden, Switzerland

[21] Appl. No.: 978,879

[22] Filed: Nov. 26, 1997

Related U.S. Application Data

[63] Continuation of Ser. No. 709,119, Sep. 6, 1996, abandoned.

[30] Foreign Application Priority Data

Oct. 2, 1995 [DE] Germany ..... 195 36 839.8

[51] Int. Cl.[6] ..... F02C 6/18

[52] U.S. Cl. ..... 60/39.02; 60/39.182

[58] Field of Search ..... 60/39.02, 39.182; 122/7 R

[56] References Cited

U.S. PATENT DOCUMENTS

| | | | |
|---|---|---|---|
| 4,424,668 | 1/1984 | Mukherjee | 60/39.182 |
| 4,501,233 | 2/1985 | Kusaka | 60/39.182 |
| 5,313,782 | 5/1994 | Frutschi et al. . | |
| 5,369,950 | 12/1994 | Bruckner et al. | 122/7 R |
| 5,386,685 | 2/1995 | Frutschi | 60/39.02 |

FOREIGN PATENT DOCUMENTS

| | | |
|---|---|---|
| 0321809A1 | 6/1989 | European Pat. Off. . |
| 0515911A1 | 12/1992 | European Pat. Off. . |
| 0582898A1 | 2/1994 | European Pat. Off. . |
| 4321081A1 | 1/1995 | Germany . |
| 480535 | 10/1969 | Switzerland . |

*Primary Examiner*—Louis J. Casaregola

*Attorney, Agent, or Firm*—Burns, Doane, Swecker & Mathis, L.L.P.

[57] ABSTRACT

In a method of operating a power station plant, which consists of a gas-turbine group (I), a steam-generating stage (II) consisting of a waste-heat steam generator (15), and a steam cycle (III), a liquid quantity increased above 100% circulates in a heat-exchange stage (15*a*), operating in the low temperature range, of the waste-heat steam generator (15). The portion above 100% of this liquid quantity is diverted at the end of said heat-exchange stage (15*a*) and is evaporated in at least one pressure stage (26). Steam (37) arising herein is then fed to a steam turbine (17) at a suitable point. A still hot liquid quantity (36) from the pressure stage (26) is fed into a feed-water tank and deaerator (22), and steam (33) arising herein is fed to a further steam turbine (18) at a suitable point.

15 Claims, 4 Drawing Sheets

METHOD OF OPERATING A COMBINED GAS AND POWER STEAM PLANT

This application is a continuation, of application Ser. No. 08/709,119, filed Sep. 6, 1996.(abandoned)

BACKGROUND OF THE INVENTION

1. Field of the Invention

The present invention relates to a method of operating a power station plant according to the preamble of claim 1.

2. Discussion of Background

In a power station plant which consists of a gas-turbine group, a waste-heat steam generator arranged downstream, and a following steam cycle, it is advantageous to provide a supercritical steam process in the steam cycle in order to achieve a maximum efficiency. CH-480 535 has disclosed such a circuit. In this circuit, for the purpose of optimum waste-heat utilization of the gas-turbine group in the low temperature range of the waste-heat steam generator, a mass flow of the gas-turbine cycle is diverted and utilized in a recuperative manner in the gas turbine. Both the gas-turbine process and the steam process have sequential combustion. However, in the case of modern gas turbines, preferably of single-shaft design, this configuration leads to an undesirable complication in terms of construction.

SUMMARY OF THE INVENTION

Accordingly, one object of the invention, in a power station plant of the type mentioned at the beginning, is to maximize the steam-cycle-side heat absorption in the low temperature range of the waste-heat steam generator—this in connection with a single-shaft gas turbine.

The essential advantages of the invention may be seen in the fact that, despite the simplest design, better utilization of the exhaust gases from the last turbine down to 100° C. and lower is effected by the heat absorption on the steam-cycle side being increased within a first heat-exchange stage in the low temperature range of the waste-heat steam generator, commonly known as the economizer.

Advantageous and expedient further developments of the achievement of the object according to the invention are defined in the further claims.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
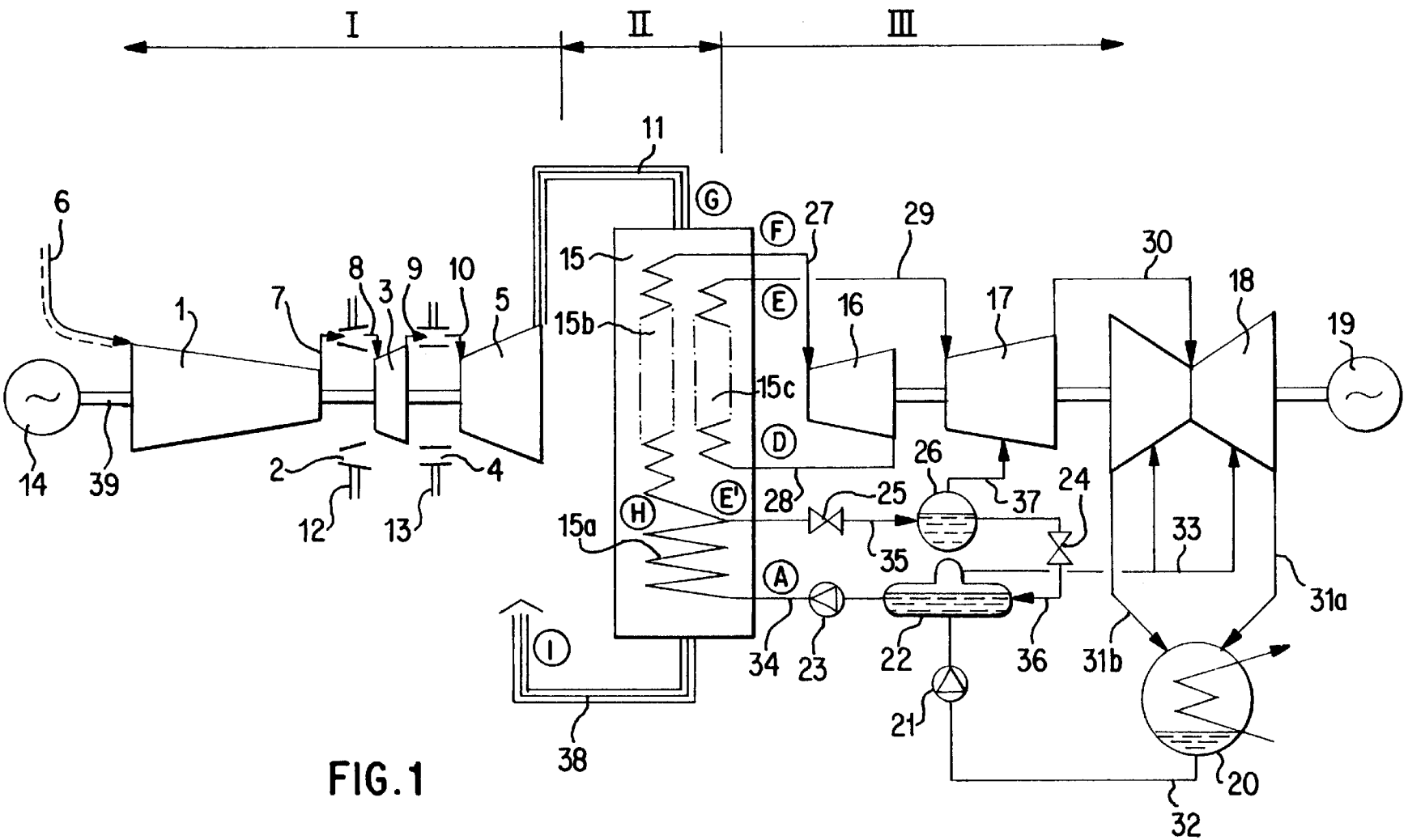
FIG. 1 shows a circuit of a power station plant.

Referring now to the drawings, wherein like reference numerals designate identical or corresponding parts throughout the several views, all elements not required for directly understanding the invention have been omitted and the direction of flow of the media is indicated by arrows, FIG. 1 shows a power station plant which consists of a gas-turbine group I, a waste-heat steam generator II arranged downstream of the gas-turbine group I, and a steam cycle III arranged downstream of this waste-heat steam generator II.

The present gas-turbine group I is based on sequential combustion. The provision (not apparent in FIG. 1) of the fuel required for operating the different combustion chambers may be effected, for example, by coal gasification interacting with the gas-turbine group. It is of course also possible to obtain the fuel used from a primary network. If a gaseous fuel for operating the gas-turbine group is provided via a pipeline, the potential from the pressure and/or temperature difference between primary network and consumer network may be recuperated for the requirements of the gas-turbine group, or the circuit in general. The present gas-turbine group, which can also act as an autonomous unit, consists of a compressor 1, a first combustion chamber 2 arranged downstream of the compressor, a first turbine 3 arranged downstream of this combustion chamber 2, a second combustion chamber 4 arranged downstream of this turbine 3, and a second turbine 5 arranged downstream of this combustion chamber 4. The said turbomachines 1, 3, 5 have a common rotor shaft 39. This rotor shaft 39 itself is preferably mounted on two bearings (not apparent in the figure) which are placed on the head side of the compressor 1 and downstream of the second turbine 5. Depending on design, the compressor 1 may be subdivided into two or more sectional compressors (not shown), for example in order to increase the specific output. In such a configuration, an intercooler is then connected downstream of the first sectional compressor and upstream of the second sectional compressor, in which intercooler the partly compressed air is intercooled. The heat accumulating in this intercooler (likewise not shown) is fed back in an optimum, that is useful, manner into the process. The intake air 6 flows as compressed air 7 into a casing (not shown in more detail) which includes the compressor outlet and the first turbine 3. The first combustion chamber 2, which is preferably designed as a continuous annular combustion chamber, is also accommodated in this casing. The compressed air 7 to the first combustion chamber 2 may of course be provided from an air-accumulator system (not shown). On the head side, the annular combustion chamber 2 has a number of burners (not shown in more detail) distributed over the periphery, which are preferably designed as premix burners. In principle, diffusion burners may also be used here. However, to reduce the pollutant emissions from this combustion, in particular as far as the NOx emissions are concerned, it is advantageous to provide an arrangement of premix burners according to European Patent 0 321 809, the subject matter of the invention from the said publication being an integral part of this description, as too is the type of fuel feed (fuel 12) described there. As far as the arrangement of the premix burners in the peripheral direction of the annular combustion chamber 2 is concerned, such an arrangement may differ from the conventional configuration of identical burners if required; premix burners of different size may be used instead. This is preferably done in such a way that a small premix burner of the same configuration is disposed in each case between two large premix burners. The size of the large premix burners, which have to perform the function of main burners, in relation to the small premix burners, which are the pilot burners of this combustion chamber, is established from case to case with regard to the burner air passing through them, that is the compressed air from the compressor 1. The pilot burners work as automatic premix burners over the entire load range of the combustion chamber, the air coefficient remaining virtually constant. The main burners are switched on or off according to certain provisions specific to the plant. Since the pilot burners can be run on an ideal mixture over the entire load range, the NOx emissions are very low even at part load. In such a configuration, the encircling flow lines in the front region of the annular combustion chamber 2 come very close up to the vortex centers of the pilot burners, so that an ignition per se is only possible with these pilot burners. During run-up, the fuel quantity which is fed via the pilot burners is increased until the latter are modulated, i.e. until the full fuel quantity is available. The configuration is selected in such a way that this point corresponds to the respective load disconnection conditions of the gas-turbine group. The further power increase is then effected via the main burners. At the peak load of the gas-turbine group, the main burners are therefore also fully modulated. Since the configuration of "small" hot vortex centers, which is initiated by the pilot burners, between the "large" cooler vortex centers originating from the main burners turns out to be extremely unstable, very good burn-out with low CO and UHC emissions in addition to the NOx emissions is achieved even in the case of main burners operated on a lean mixture in the part-load range, i.e. the hot vortices of the pilot burners penetrate immediately into the small vortices of the main burners. The annular combustion chamber 2 may of course consist of a number of individual tubular combustion spaces which are likewise arranged in an inclined annular shape, sometimes also helically, around the rotor axis. This annular combustion chamber 2, irrespective of its design, is and may be arranged geometrically in such a way that it has virtually no effect on the rotor length. The hot gases 8 from this annular combustion chamber 2 are admitted to the first turbine 3 arranged directly downstream, the thermally expanding action of which on the hot gases is deliberately kept to a minimum, i.e. this turbine 3 will accordingly consist of no more than two rows of moving blades. In such a turbine 3 it will be necessary to provide pressure compensation at the end faces for the purpose of stabilizing the axial thrust. The hot gases 9 partly expanded in the turbine 3 and flowing directly into the second combustion chamber 4 are at quite a high temperature for the reasons explained; for specific operational reasons the design is preferably to allow for a temperature which is certainly still around 1000° C. This second combustion chamber 4 essentially has the form of a continuous annular, axial or quasi-axial cylinder. This combustion chamber 4 may of course also consist of a number of axially, quasi-axially or helically arranged and self-contained combustion spaces. As far as the configuration of the annular combustion chamber 4 consisting of a single combustion space is concerned, a plurality of fuel lances (not shown in more detail in the figure) are disposed in the peripheral direction and radial direction of this annular cylinder. This combustion chamber 4 has no burners; the combustion of a fuel 13 injected into the partly expanded hot gases 9 coming from the turbine 3 takes place here by self-ignition, if indeed the temperature level permits such a mode of operation. Starting from the assumption that the combustion chamber 4 is operated with a gaseous fuel, that is, for example, natural gas, the outlet temperature of the partly expanded hot gases 9 from the turbine 3 must still be very high, around 1000° C. as explained above, and this of course must also be the case during partload operation, a factor which plays a causal role in the design of this turbine 2. In order to ensure the operational reliability and a high efficiency in the case of a combustion chamber designed for selfignition, it is of the utmost importance that the flame front remains locally stable. For this purpose, a number of elements (not shown in more detail) are provided in this combustion chamber 4, preferably so as to be disposed on the inner and outer wall in the peripheral direction, which elements are placed in the axial direction preferably upstream of the fuel lances. The task of these elements is to generate vortices which induce a backflow zone, analogous to that in the premix burners already mentioned. Since this combustion chamber 4, on account of the axial arrangement and the overall length, is a high-velocity combustion chamber in which the average velocity of the working gases is greater than about 60 m/s, the vortex-generating elements must be designed to conform to the flow. On the inflow side, these elements are to preferably consist of a tetrahedral shape having inclined surfaces with respect to the inflow. The vortex-generating elements may be placed on the outer surface and/or on the inner surface. The vortex-generating elements may of course also be displaced axially relative to one another. The outflow-side surface of these vortex-generating elements is essentially of radial design so that a backflow zone appears starting from this location. However, the self-ignition in the combustion chamber 4 must also continue to be assured in the transient load ranges as well as in the part-load range of the gas-turbine group, i.e. auxiliary measures must be provided which ensure the self-ignition in the combustion chamber 4 even if the temperature of the gases in the region of the injection of the fuel should vary. In order to ensure reliable self-ignition of the gaseous fuel injected into the combustion chamber 4, a small quantity of another fuel having a lower ignition temperature is added to this fuel. Fuel oil, for example, is very suitable here as "auxiliary fuel". The liquid auxiliary fuel, appropriately injected, performs the task of acting so to speak as a fuse and permits self-ignition in the combustion chamber 4 even if the partly expanded hot gases 9 from the first turbine 3 should be at a temperature below the desired optimum level of 1000° C. This measure of providing fuel oil for ensuring self-ignition certainly always proves to be especially appropriate when the gas-turbine group is operated at greatly reduced load. Furthermore, this measure is a decisive factor in enabling the combustion chamber 4 to have a minimum axial length. The short overall length of the combustion chamber 4, the action of the vortex-generating elements for stabilizing the flame and also the continual guarantee of self-ignition are accordingly responsible for the combustion being effected very quickly, and the dwell time of the fuel in the region of the hot flame front remains minimal. An effect resulting herefrom which is directly measurable from the combustion relates to the NOx emissions, which are minimized in such a way that they are now no longer relevant. Furthermore, this initial situation enables the location of the combustion to be clearly defined, which is reflected in optimized cooling of the structures of this combustion chamber 4. The hot gases 10 prepared in the combustion chamber 4 are then admitted to a second turbine 5 arranged downstream. The thermodynamic characteristics of the gas-turbine group may be designed in such a way that the exhaust gases 11 from the second turbine 5 still have so much thermal potential to thus operate a steam-generating stage II, shown here with reference to a waste-heat steam generator 15, and a steam cycle III. As already pointed out in the description of the annular combustion chamber 2, this annular combustion chamber 2 is arranged geometrically in such a way that it has virtually no effect on the rotor length of the gas-turbine group. Furthermore, it can be established that the second combustion chamber 4 running between the outflow plane of the first turbine 3 and the inflow plane of the second turbine 5 has a minimum length. Furthermore, since the expansion of the hot gases in the first turbine 3, for the reasons explained, takes place over few rows of moving blades, a gas-turbine group can be provided whose rotor shaft 39 can be supported on two bearings in a technically satisfactory manner on account of its minimized length. The turbomachines deliver power via a generator 15, which is coupled on the compressor side and may also serve as a pony motor. After expansion in the turbine 5, the exhaust gases 11 still provided with a high thermal potential flow through a waste-heat steam generator 15 in which steam is generated repeatedly by heat-exchange process, which steam then forms the working medium of the steam cycle arranged downstream. The thermally utilized exhaust gases then flow as flue gases 38 into the open.

On the assumption that the exhaust gases 11, which pass at G into the waste-heat steam generator 15, the mode of operation of which will be described further below, in which case the path of the feed water 34 flowing into the waste-heat steam generator 15 and delivered by a pump 23 will be followed, have a temperature of about 620° C., and provided there is a minimum jump in temperature of about 20° C. for the heat transfer, these exhaust gases could only be usefully cooled down to 200° C. In order to remove this disadvantage here, the quantity of feed water 34 is increased between the points A, namely the inlet of the feed water 34 to the waste-heat steam generator 15, and B, diverting point at the end of the treatment within an economizer stage 15*a*, to such an extent, in the example to 180%, that the cooling line (cf. FIG. 2, item 11/38) of the exhaust gases bends as resultant at point H (cf. FIG. 2, item 41), namely directly upstream of the diverting point B, which bend extends down to 100° C. In connection with the percentage quantity of feed water, 100% defines that nominal water quantity which is in relationship to the energy offered by the exhaust gases 11.

The feed water 34, which has a temperature of about 60° C. at a pressure of about 300 bar, is directed at A into the waste-heat steam generator 15 and is to be thermally refined there into steam at about 540° C. The feed water heated in the economizer 15*a* to about 300° C. is split into two partial flows at point B. The one partial water flow (the larger here) of 100% is thermally processed in the following tube bank 15*b* to form supercritical high-pressure steam 27. The main portion of the thermal energy is thereby extracted from the exhaust gases 11 between the points G and H, which symbolize the effective section of said tube bank 15*b*. After a first expansion in a high-pressure steam turbine 16, this steam 23 is reheated with the remaining energy between points D and E, symbolizing the effective section of a further tube bank 15*c* in the waste-heat steam generator 15, and is fed as intermediate-pressure steam 29 to an intermediate-pressure steam turbine 17. The residual expansion of the exhaust steam 30 from the intermediate-pressure steam turbine 17 is then effected in a low-pressure steam turbine 18, which is coupled to a further generator 19. It is also possible to transmit the output to the generator 14 by coupling to the shaft 39.

A smaller partial water flow 35 is diverted in the region of point B and is fed via a throttle member 25 to an evaporation chamber 26, the pressure level of which corresponds to the saturated-steam pressure of 150°–200° C. The steam 37 resulting from this is fed to the intermediate-pressure steam turbine 17 at a suitable point. The still hot residual water 36, which has merely served as heat transfer medium for the evaporation, is directed via a further control member 24 into a feed-water tank and deaerator 22, in which, apart from the preheating of the condensate, further steam 33 is also developed which is fed to the low-pressure steam turbine 18 at a suitable point.

The ultimately expanded steam 31*a*, 31*b* from this low-pressure steam turbine 18 is condensed in a water- or air-cooled condenser 20. By means of a condensate pump 21 acting downstream of this condenser 20, the condensate 32 is delivered into the feed-water tank and deaerator 22 already mentioned, from where the cycle already described starts again.

To improve the energy utilization of the evaporation cascade described, it can be effected in more than two stages.

Figure 3:
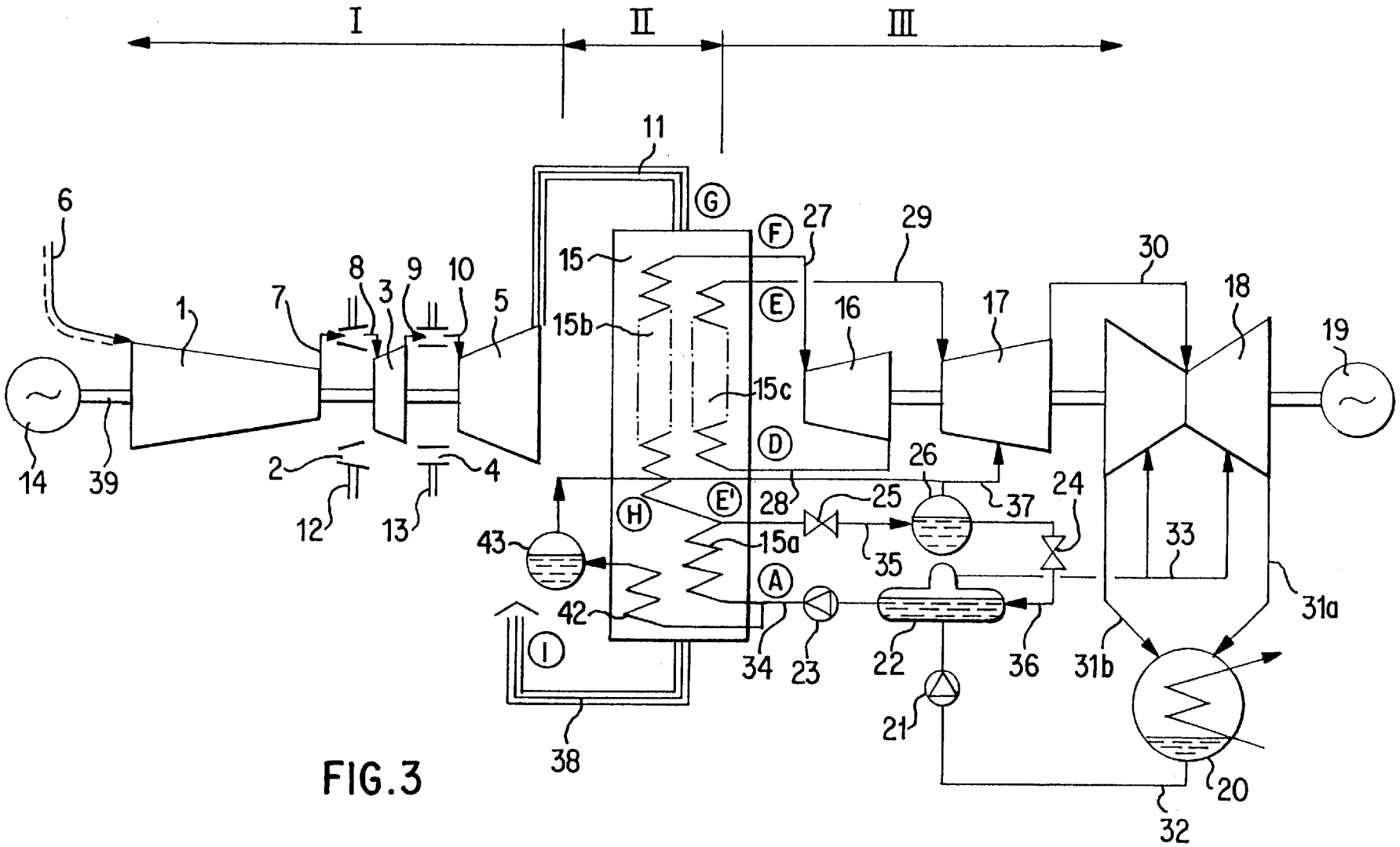
FIG. 3 shows a circuit of a power station plant according to a further embodiment of the present invention.
Figure 4:
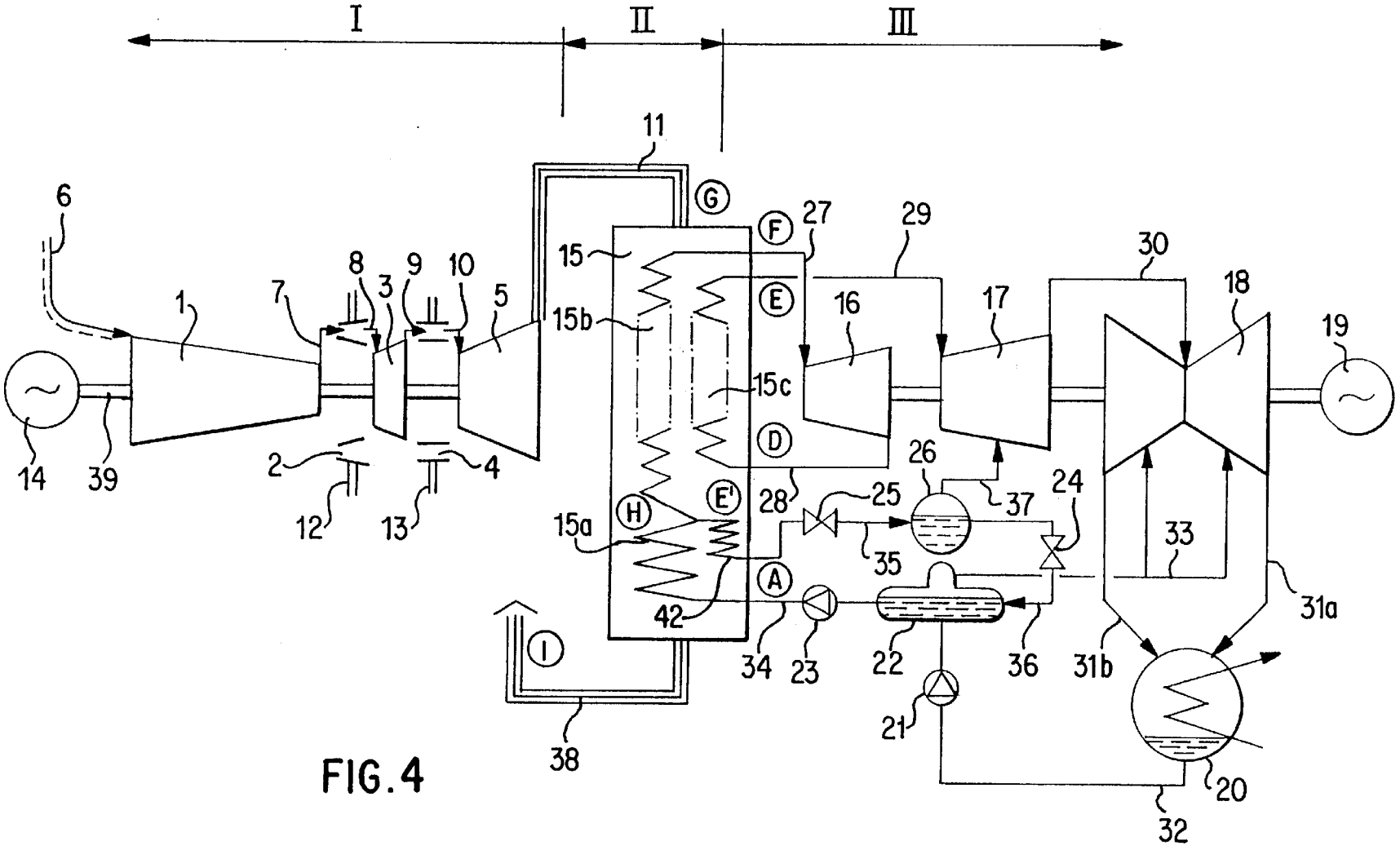
FIG. 4 shows a circuit of a power station plant according to yet another embodiment of the present invention.

In order to obtain good utilization of the exhaust gases 11, a separate steam-generating device or heat exchange element 42 may of course be integrated in the waste-heat steam generator 15, either in parallel with the economizer 15*a* as shown in FIG. 3 or in series with the economizer 15*a* as shown in FIG. 4. The steam from heat exchange element 42 is either directed into the steam cycle III or is converted into work in a separate expansion machine. However, a partial flow of the exhaust gases may also be diverted and utilized in a separate waste-heat boiler 43. Instead of water, an ammonia/water mixture can preferably be used in this case. But other fluids, such as, for example, freon, propane, etc., can also be used. A certain improvement in the utilization of the exhaust gases from the turbine down to a lower level can also be realized by the temperature level at the inlet of the waste-heat steam generator being raised by supplementary firing (not shown in more detail) in the waste-heat steam generator. However, this measure does not bring about any improvement with regard to the efficiency attainable.

Figure 2:
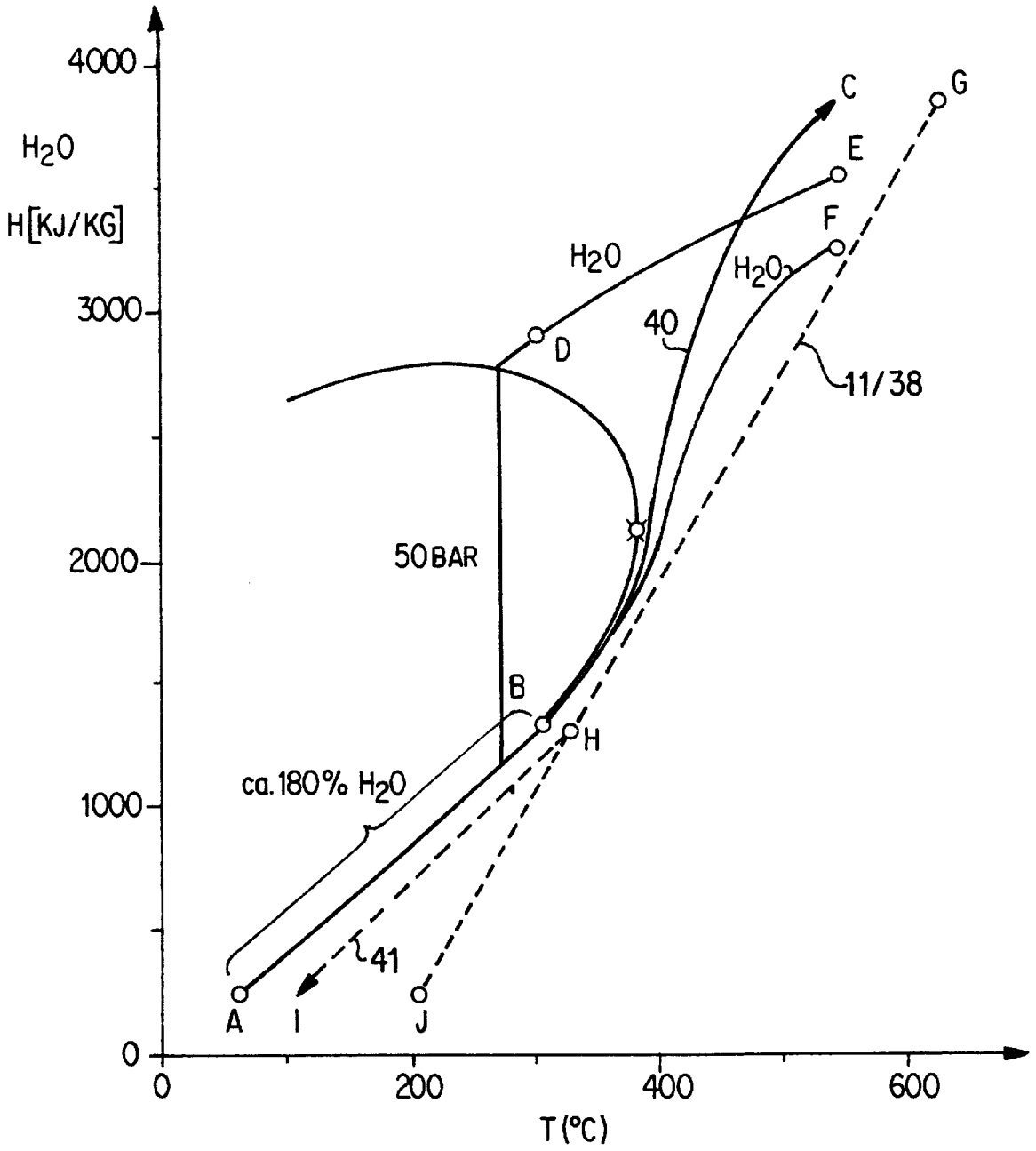
FIG. 2 shows an H/T diagram of this circuit according to FIG. 1.

FIG. 2 shows the H/T diagram, i.e. the progression and the significant points, already considered in FIG. 1, of the feed-water preheating and steam generation as well as steam reheating of a supercritical steam-turbine process. The respective designations of this figure are defined more precisely in the subsequent list of designations. The following additional remarks amplify the statements made with respect to FIG. 1 which are connected with the representation of this diagram. The feed water is fed in at A at, for example, 60° C. and 300 bar and it is to be thermally refined into steam at 540° C. up to point F by means of gas-turbine waste heat. After a first expansion stage in the high-pressure steam turbine, which leads up to 300° C., reheating from D to E, that is also to 540° C., is to take place. The solid line 40 shows the resulting progression of the heat absorption and the temperature. On the assumption that the exhaust gases from the last gas turbine have a temperature of 620° C., and provided there is a minimum jump in temperature of 20° C. for the heat transfer, these exhaust gases could only be usefully cooled down to point J, i.e. here in the example only to 200° C. In order to remove this disadvantage, the feed-water quantity is increased between points A and B to such an extent (in the example to 180%) that the cooling curve 11/38 of the exhaust gases bends at point H as resultant 41 and extends down to I, i.e. down to 100° C. This additional feed-water flow is removed at B and fed to an evaporation cascade (cf. FIG. 1) in such a way that the resulting steam can be fed to the intermediate-pressure and low-pressure part of the steam turbine, as likewise apparent from FIG. 1. The remaining points will likewise be appreciated from the description of FIG. 1.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a method for operating a power station plant having a gas-turbine group, a waste-heat steam generator arranged downstream of the gas-turbine group, and a steam cycle arranged downstream of the waste-heat steam generator, the gas-turbine group includes at least one compressor unit, at least one combustion chamber, at least one turbine and at least one generator, the exhaust gases from the at least one turbine define a heat source for a predetermined liquid quantity flowing through the waste-heat steam generator, the predetermined liquid quantity in the waste-heat generator generates steam for operating at least one steam turbine of the steam cycle, a method improvement comprising:

increasing the liquid quantity above the predetermined liquid quantity in a first heat exchange stage operating in the low temperature range of the waste-heat steam generator;

diverting a portion of the liquid above the predetermined liquid quantity at the end of the first heat-exchange stage;

directing the diverted portion of the liquid to at least one evaporation chamber and feeding steam generated in the evaporation chamber to a steam turbine;

directing the residual diverted portion of liquid in the at least one evaporation chamber to a feedwater tank and deaerator, and feeding steam generated in the feedwater tank and deaerator to a further steam turbine.

2. The method as claimed in claim 1, further comprising the steps of:

processing the predetermined liquid quantity in a second heat-exchange stage, directly following the first heat-exchange stage of the waste-heat steam generator and forming supercritical steam;

admitting the supercritical steam to the at least one steam turbine of the steam cycle;

expanding steam in the at least one steam turbine and feeding the expanded steam back into the waste-heat steam generator;

processing the expanded steam in a third heat-exchange stage of the waste-heat steam generator and forming reheated steam; and admitting the reheated steam to a corresponding pressure stage of the steam turbine.

3. The method as claimed in claim 1, wherein the feed-water tank and deaerator define an evaporation stage of the steam cycle arranged downstream of the waste-heat steam generator.

4. The method as claimed in claim 1, further comprising directing the portion of liquid above the predetermined liquid quantity to a separate heat-exchange element in parallel with the first heat-exchange stage in the low temperature range.

5. The method as claimed in claim 1, further comprising directing the portion of liquid above the predetermined liquid quantity to a separate heat-exchange element in series with the first heat-exchange stage in the low temperature range.

6. The method as claimed in claim 4, wherein the portion of liquid above the predetermined liquid quantity includes a first type of liquid and the predetermined liquid quantity includes a second type of liquid different from the first type of liquid, and wherein thermal energy resulting from the heat exchange in the separate heat-exchange element is utilized in a separate machine.

7. The method as claimed in claim 5, wherein the portion of liquid above the predetermined liquid quantity includes a first type of liquid and the predetermined liquid quantity includes a second type of liquid different from the first type of liquid, and wherein thermal energy resulting from the heat exchange in the separate heat-exchange element is utilized in a separate machine.

8. A method for operating a power station plant having a gas-turbine group, a waste-heat steam generator arranged downstream of the gas-turbine group, and a steam cycle arranged downstream of the waste-heat steam generator, the gas-turbine group includes at least one compressor unit, at least one combustion chamber, at least one turbine and at least one generator, the method comprising the steps of:

defining a predetermined liquid quantity flowing through the waste-heat steam generator and heating the predetermined liquid quantity with the exhaust gases from the at least one turbine of the gas-turbine group, the predetermined liquid quantity in the waste-heat generator generating steam for operating at least one steam turbine of the steam cycle;

increasing the liquid quantity above the predetermined liquid quantity in a first heat exchange stage operating in the low temperature range of the waste-heat steam generator;

diverting a portion of the liquid above the predetermined liquid quantity at the end of the first heat-exchange stage;

directing the diverted portion of the liquid to at least one evaporation chamber and feeding steam generated in the evaporation chamber to a steam turbine;

directing the residual diverted portion of liquid in the at least one evaporation chamber to a feedwater tank and deaerator, and feeding steam generated in the feedwater tank and deaerator to a further steam turbine.

9. The method as claimed in claim 8, wherein the at least one turbine of the gas-turbine group comprises a first turbine and a second turbine, and the at least one combustion chamber comprises a first combustion chamber upstream of the first turbine and a second combustion chamber between the first and second turbine, the second turbine being arranged downstream of the first turbine such that the gas-turbine group operates in sequential combustion.

10. The method as claimed in claim 8, further comprising the steps of:

processing the predetermined liquid quantity in a second heat-exchange stage, directly following the first heat-exchange stage of the waste-heat steam generator and forming supercritical steam;

admitting the supercritical steam to the at least one steam turbine of the steam cycle;

expanding steam in the at least one steam turbine and feeding the expanded steam back into the waste-heat steam generator;

processing the expanded steam in a third heat-exchange stage of the waste-heat steam generator and forming reheated steam; and admitting the reheated steam to a corresponding pressure stage of the steam turbine arranged downstream.

11. The method as claimed in claim 8, wherein the feed-water tank and deaerator define an evaporation stage of the steam cycle arranged downstream of the waste-heat steam generator.

12. The method as claimed in claim 8, further comprising directing the portion of liquid above the predetermined liquid quantity to a separate heat-exchange element in parallel with the first heat-exchange stage in the low temperature range.

13. The method as claimed in claim 8, further comprising directing the portion of liquid above the predetermined liquid quantity to a separate heat-exchange element in series with the first heat-exchange stage in the low temperature range.

14. The method as claimed in claim 12, wherein the portion of liquid above the predetermined liquid quantity includes a first type of liquid and the predetermined liquid quantity includes a second type of liquid different from the first type of liquid, and wherein thermal energy resulting from the heat exchange in the separate heat-exchange element is utilized in a separate machine.

15. The method as claimed in claim 13, wherein the portion of liquid above the predetermined liquid quantity includes a first type of liquid and the predetermined liquid quantity includes a second type of liquid different from the first type of liquid, and wherein thermal energy resulting from the heat exchange in the separate heat-exchange element is utilized in a separate machine.

* * * * *